United States Patent [19]

Cottam

[11] 4,145,243

[45] Mar. 20, 1979

[54] PIPE WRAPPING COATING APPARATUS

[75] Inventor: Spencer D. Cottam, Cypress Way, Tex.

[73] Assignee: Midcon Pipeline Equipment Co., Houston, Tex.

[21] Appl. No.: 853,111

[22] Filed: Nov. 21, 1977

[51] Int. Cl.[2] ..... B65H 81/00

[52] U.S. Cl. ..... 156/392; 156/428

[58] Field of Search ..... 156/392, 428, 430, 431, 156/432

[56] References Cited

U.S. PATENT DOCUMENTS

| | | | |
|---|---|---|---|
| 1,883,401 | 10/1932 | Rolfs et al. | 156/428 |
| 2,344,264 | 3/1944 | Perrault | 156/392 |
| 3,470,057 | 9/1969 | Stuart, Jr. et al. | 156/392 |
| 4,008,114 | 2/1977 | Lindsey | 156/392 |

*Primary Examiner*—Douglas J. Drummond
*Attorney, Agent, or Firm*—Carl B. Fox, Jr.

[57] ABSTRACT

Pipe wrapping and coating apparatus, wherein one or more rolls of tape for wrapping the pipe are mounted on spindles supported by pivotal frames whereby the frames and the rolls of tape carried thereby pivotally self-adjust angularly so that the tape is wrapped flatly onto the pipe automatically and the overlap of adjacent tape wraps is made uniform automatically. The apparatus is supported by an adjustable wheeled carrier adapted to support the apparatus weight when the apparatus is mounted on pipes of diverse sizes. The apparatus includes a reservoir for dispensing coating material prior to wrapping, and includes novel coating application means.

25 Claims, 20 Drawing Figures

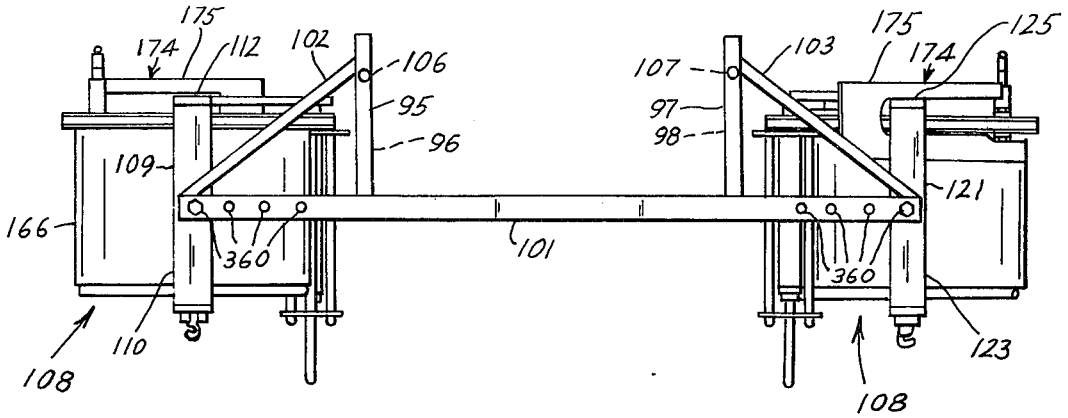
Fig. 4
Fig. 5
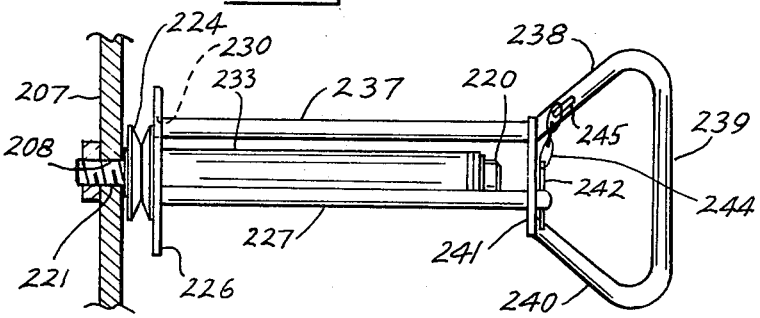
Fig. 6
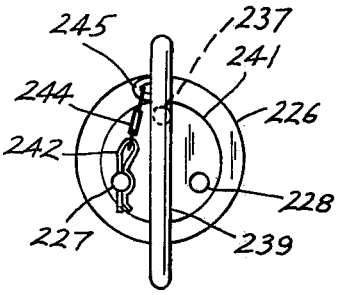
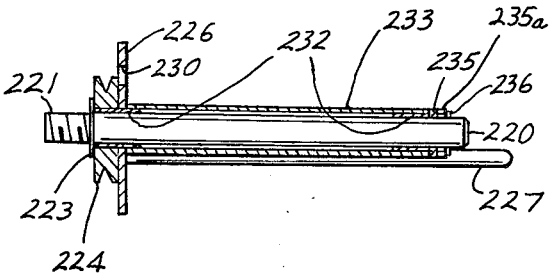
Fig. 7
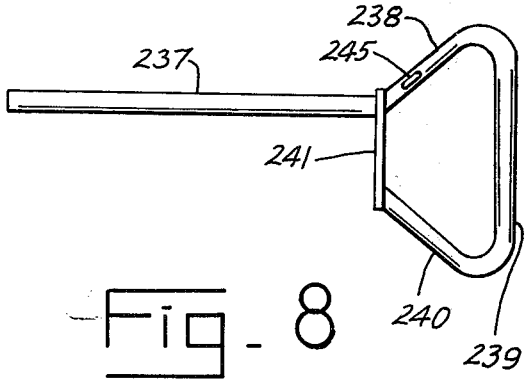
Fig. 8

PIPE WRAPPING COATING APPARATUS

BACKGROUND OF THE INVENTION

In conventional pipe wrapping apparatuses, adjustment of the tape roll angle is a difficult problem frequently requiring constant supervision and frequent adjustments in order that the tape will be placed around the pipe at a uniform angle with substantially uniform overlap of successive wraps or passes about the pipe. One solution to this problem was advanced in United States of America application for Letters Patent Ser. No. 743,699, filed Nov. 22, 1976, now U.S. Pat. No. 4,069,088 by the same applicant and entitled "Pipe Wrapping Apparatus". While the apparatus disclosed in that application performs entirely satisfactorily, it is somewhat more complicated and cumbersome than the apparatus herein disclosed, which amounts to an improvement over the apparatus shown in the prior application. Another problem frequently encountered in the case of pipe wrapping apparatuses is the uniform distribution of coating material prior to wrapping, whereby a sealed wrapping operation may be accomplished. According to the present invention, an improved apparatus for distribution of the coating material prior to wrapping is supplied.

SUMMARY OF THE INVENTION

The invention provides a combined apparatus for coating and wrapping pipe. The apparatus is simple and light weight in character, whereby it may be easily handled and operated. The apparatus is extremely efficient and rapid in its operation as compared with conventional apparatuses. The apparatus is designed for use on pipes of different sizes, so that separate apparatuses for different sizes of pipes need not be provided. One or more tape rolls are carried by the apparatus, supported on spindles carried by pivotal frames. The frames move pivotally in response to the angular direction of tape application onto the pipe and automatically provide that the tape goes onto the pipe in flat spiral disposition with uniform overlaps of adjacent courses of the tape wrapped thereon. No adjustments of tape spindle angle need be made, as such adjustment is provided automatically. Adjustments of the apparatus for use on different pipe sizes are simple and non-time consuming. The apparatus includes means for adjusting tape tension whereby uniformity of tape tension in wrapping of a pipe is readily accomplished. Provision is made whereby the apparatus may be installed about a pipe at any point of the length of pipe, so that it is not necessary that the apparatus be placed about the pipe at an end of the pipe.

The apparatus may include means for coating of the pipe prior to wrapping, such apparatus being automatic in operation and simple in design, yet thoroughly effective and dependable.

A principal object of the invention is to provide pipe wrapping apparatus of improved design. Another object of the invention is to provide such an apparatus wherein the tape spindle or spindles are pivotally mounted whereby the tape angle with respect to the pipe is automatically adjusted. A further object of the invention is to provide such an apparatus wherein tape tension may be adjusted to be constant and uniform. Another object of the invention is to provide carriage means for the apparatus which is of simple design and adjustable to fit pipes of diverse sizes. Yet another object of the invention is to provide such an apparatus wherein the carriage means includes pivotally mounted upper and lower wheels which may be simultaneously pivoted to fit pipes of different diameters. A still further object of the invention is to provide such an apparatus including improved means for spreading pipe coating upon the pipe surface prior to wrapping of the pipe. A final object of the invention is to provide such an apparatus which is light in weight, inexpensive, and yet is dependable and efficient in operation.

Other objects and advantages of the invention will appear from the following detailed description of a preferred embodiment thereof, reference being made to the accompanying drawings.

BRIEF DESCRIPTIONS OF THE DRAWINGS

FIG. 4 is a partial top view showing the spindle apparatus and supports therefor.

FIG. 5 is an enlarged partial view showing a tape backing take-up spindle.

FIG. 6 is an end view of the apparatus shown in FIG. 5.

FIG. 7 is a vertical cross section of the spindle.

FIG. 8 is a side elevation of a release element of the take-up spindle apparatus.

DESCRIPTION OF THE PREFERRED EMBODIMENTS

Figure 1:
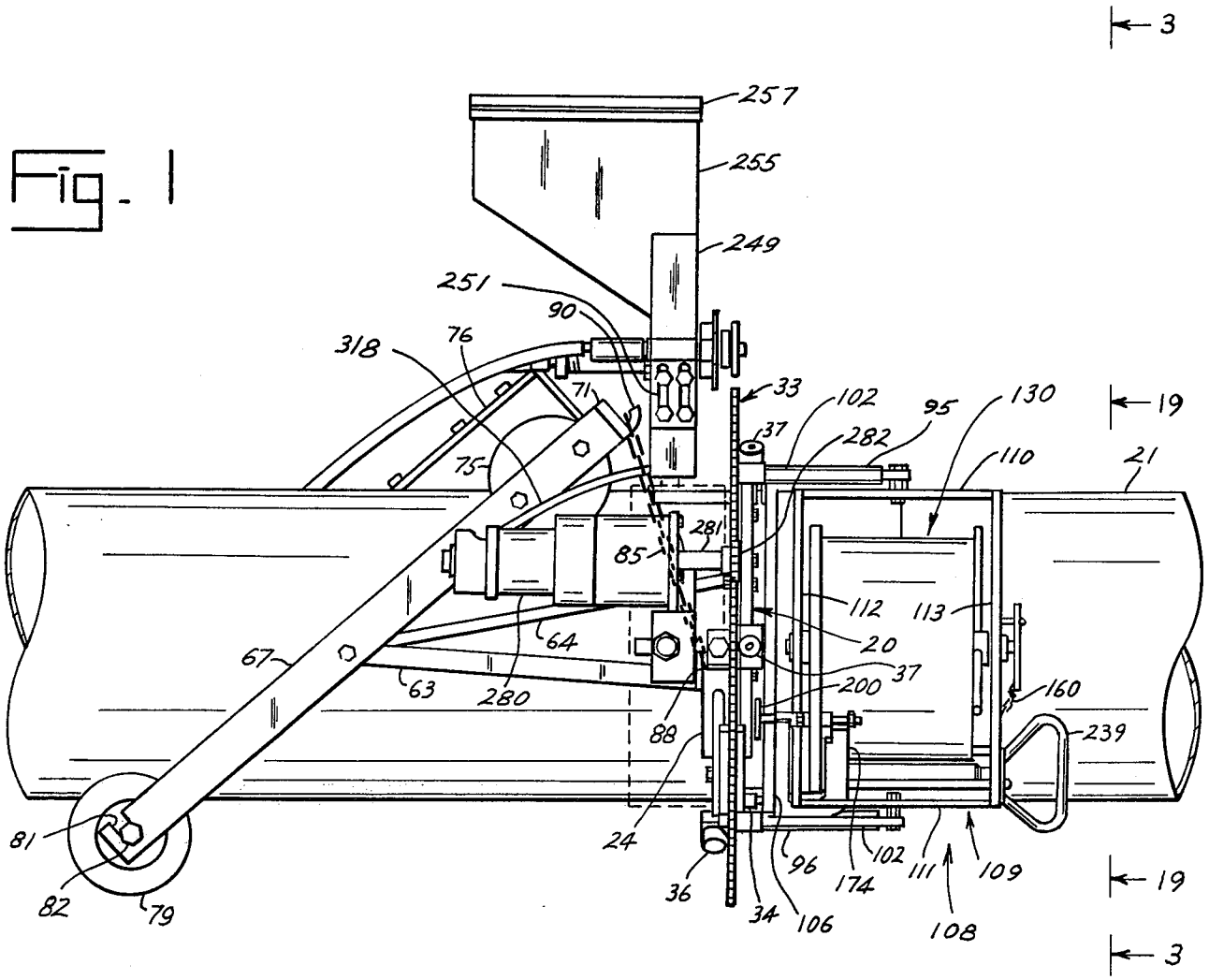
FIG. 1 is a side elevation showing one side of the apparatus, the apparatus being shown mounted upon a pipe.
Figure 2:
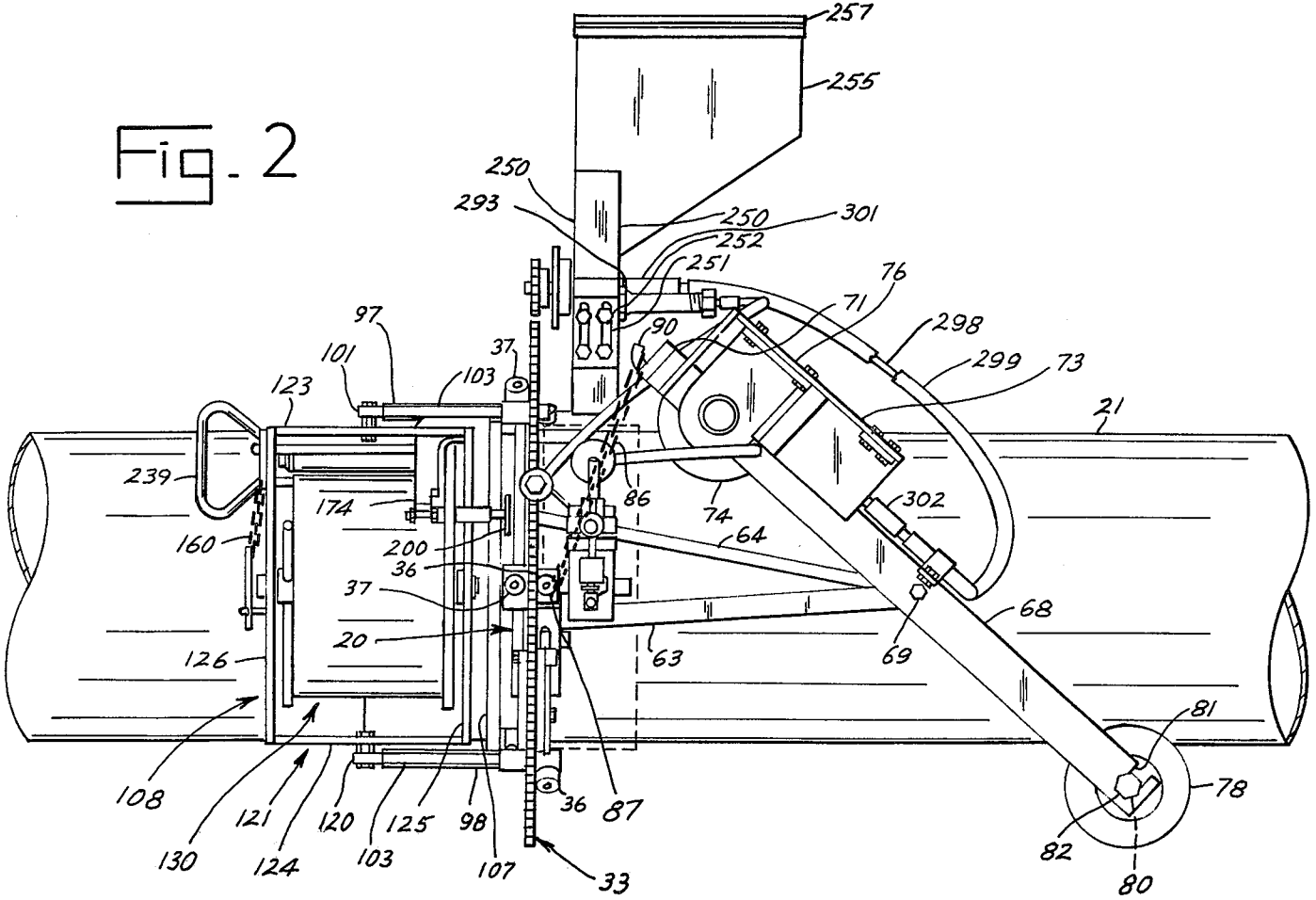
FIG. 2 is a side elevation showing the opposite side of the apparatus shown in FIG. 1.
Figure 3:
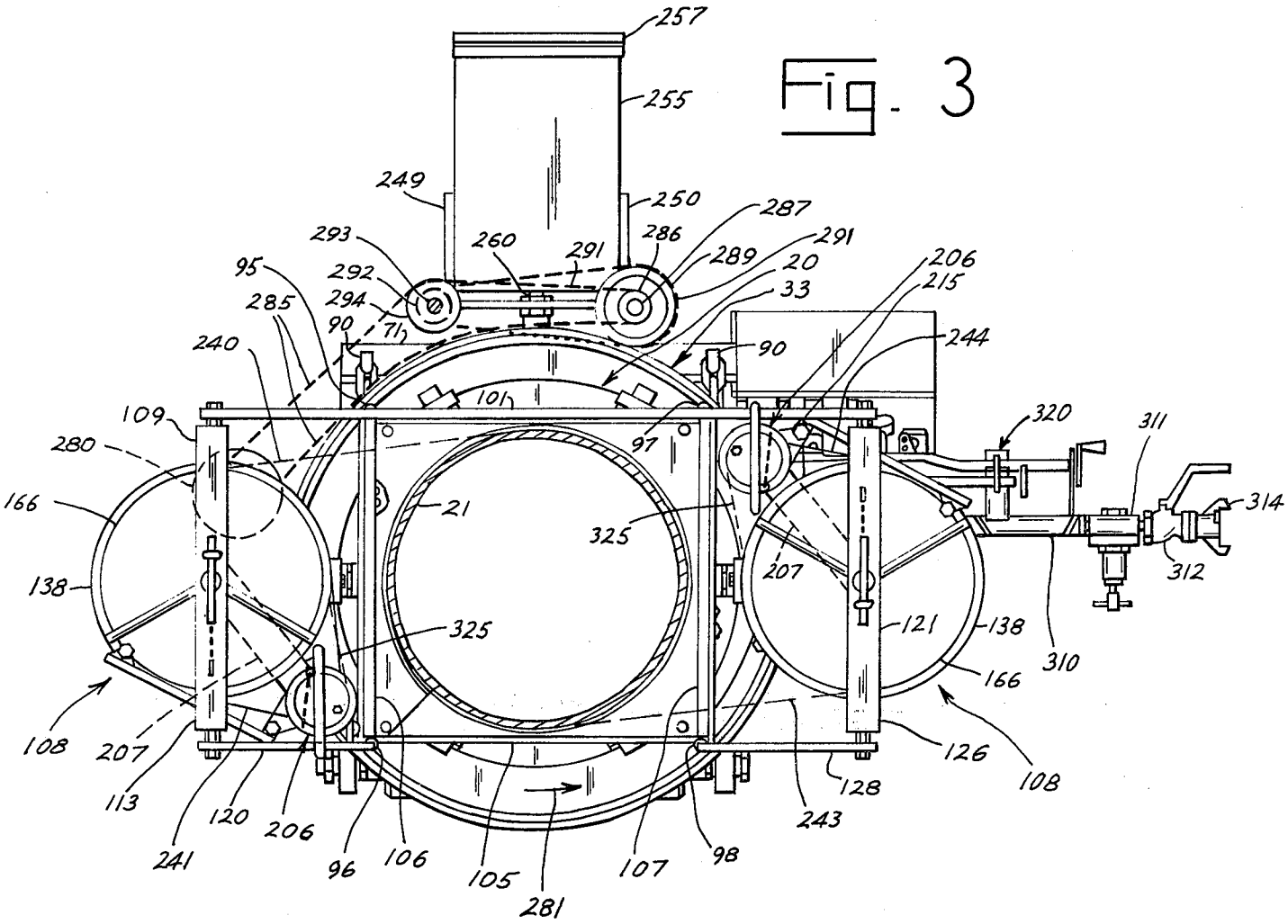
FIG. 3 is an end elevation of the apparatus shown in FIGS. 1 and 2, taken at line 3—3 of FIG. 1.
Figure 9:
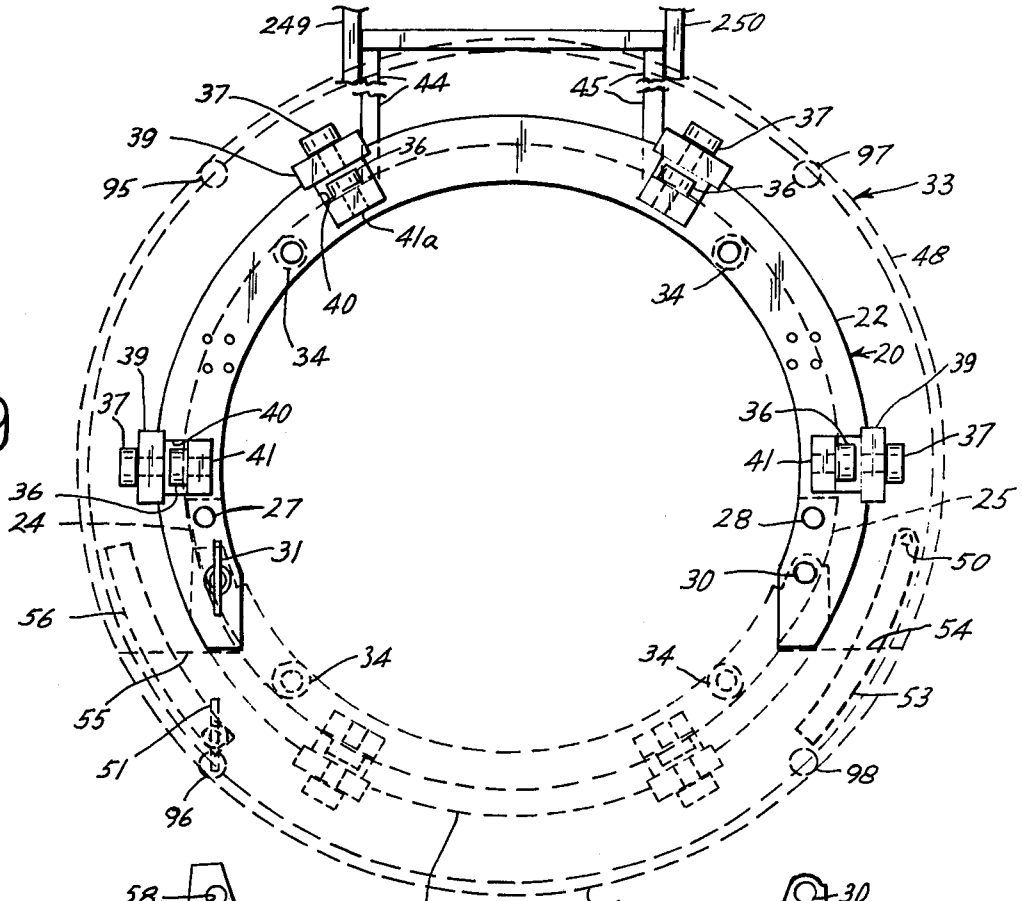
FIG. 9 is an enlarged elevation of the upper part of a ring assembly used in the apparatus, the lower part being shown in dashed lines and a ring gear assembly employed therewith being shown in dashed lines.
Figure 10:
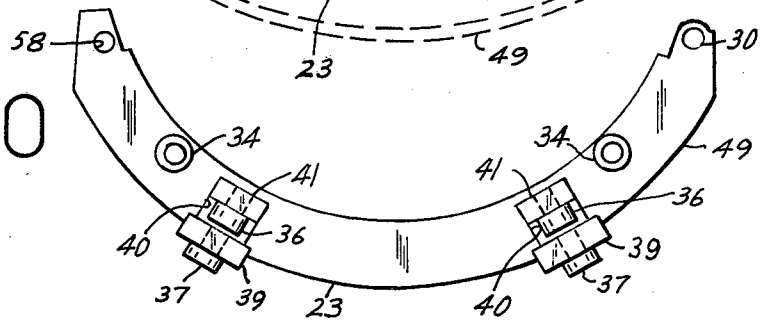
FIG. 10 is an enlarged elevation of the lower part of the ring assembly shown in FIG. 9.
Figure 11:
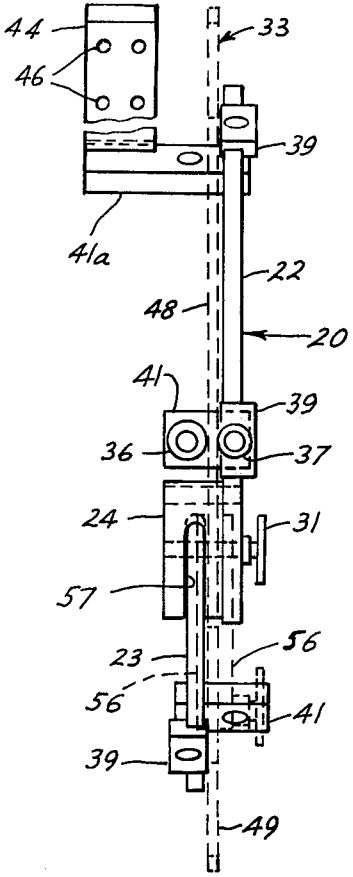
FIG. 11 is an enlarged side elevation of the ring assembly of FIGS. 9 and 10.

Referring first to FIGS. 1-3 of the drawings, which show a preferred embodiment of apparatus according to the invention, and to FIGS. 9-11 of the drawings, the main support element of the apparatus is a ring assembly 20. Ring assembly 20 is disposed to encircle a pipe 21 about which the apparatus may be disposed. Ring assembly 20 is shown in detail in FIGS. 9–11 of the drawings. The ring assembly includes an upper portion 22 and a lower portion 23, which are hinged together. Upper ring portion 22 has a pair of slotted block assemblies 24, 25 which are bolted by bolts 27, 28, respectively, to its opposite ends, both at the same side of ring portion 22. The lower ring element 23 is inserted at its opposite ends into the slots of elements 24, 25, being connected pivotally to slotted block 25 at pivot pin 30 and releasably connected to slotted block 24 at latch pin connection 31. When the latch pin connection 31 is released, the lower ring portion 23 may be swung downwardly and to the right hand side in order to enable positioning of the apparatus about a pipe 21 from the side of the pipe rather than from the end of the pipe. The lower ring portion 23 is shown in dashed lines in FIG. 9, and in solid lines in FIG. 10.

Figure 18:
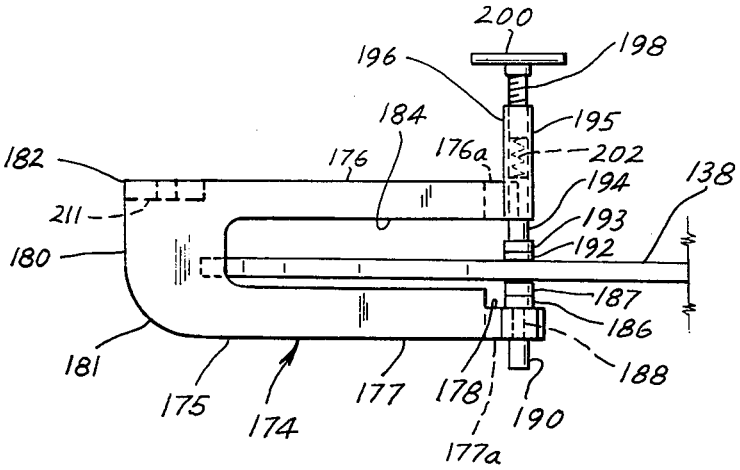
FIG. 18 is a side elevation of a brake assembly employed in connection with the invention.

A ring gear assembly 33, shown by dashed lines in FIGS. 9 and 11, is rotatively carried around ring assembly 20. Four rollers 34 carried by the ring assembly 20 engage the inner periphery of ring gear 33. Plural circularly spaced rollers 36, 37 (see FIG. 18) are disposed at the opposite faces of ring gear assembly 33 to maintain the ring gear assembly against axial movements. The rollers 37 are carried by bars 39 welded in the radially outer wider portions of slots 40 of the ring gear assembly. The rollers 36 are carried by bars **41, 41*a* which are affixed in the radially inner narrower portions of slots 40, as shown. The bars 39 extend to one side of the upper ring element 22 and to the other side of lower ring element 23. The bars 41 and 41*a* extend to the opposite sides of ring elements 22, 23 from bars 39. The supporting bars 41*a* are the same as the supporting bars 41 except that they extend to a greater distance from the ring assembly in order to provide support for upright elements 44, 45. The upright members 44, 45 have bolt holes 46** therethrough by means of which an upper assembly to be described is supported.

In the drawings, six sets of rollers 36, 37 are shown to be provided, but any suitable number may be used. Some of the rollers 36, 37 are not shown in FIG. 11 in order to improve the clarity of the drawing. It will be recognized that the rollers 36, 37 are spaced apart a proper distance to support ring gear assembly 33 therebetween, the rollers 36 bearing on one side of the ring gear assembly and the rollers 37 bearing on the opposite side of the ring gear assembly.

The ring gear assembly 33 is composed of upper part 48 and lower part 49, these being hingedly connected at pin 50 and releasably latched at releasable connection 51 whereby the lower part 49 may be swung out of the way for insertion of the apparatus around a pipe in the same manner as the ring assembly 20.

At the righthand side of FIG. 9, a pair of curved bars 53 are disposed at opposite faces of ring gear elements 48 and 49. The bars 53 are welded along their edges to the element 49, and the parts of bars 53 overlapping ring gear element 48 are not welded thereto, but are pivotally affixed by a pivot pin 50. This enables the element 49 and the bars 53 to swing downwardly and outwardly around pivot 50 to enable ring gear part 49 to be moved for entrance or removal of a pipe from within the ring gear assembly. The elements 48, 49 abut end-to-end at 54. At the other side of the apparatus, the elements 48, 49 abut end-to-end at line 55. A pair of curved bars 56, one at each side of the ring gear elements, are welded along their edges to ring gear element 48. The portions of bars 56 which overlap ring gear element 49 are not welded thereto, but are secured by releasable latch 51.

The latches 31 and 51 are of a type having a threaded shaft or screw which is screwed inwardly and outwardly. In the case of latch 31, the screw bridges the slot 57 and passes through a hole 58 in the end of element 22. When the screw 59 is withdrawn, the ends of elements 21, 22 may be separated to cause hinged motion at pin 30.

In the case of latch 51, the latch is mounted on one of the bars 56, the screw passing through a hole through element 49 and then through a tapped opening through the opposite bar 56. When the bolt is withdrawn, the ends of elements 49 and 48 may be separated.

A pair of arms 63, 64 (see FIGS. 1, 2 and 12) are fixed to ring element 22 at each horizontal side of the hole through the ring structure through which the pipe passes. The bars 63 are inclined slightly downwardly toward the ring assembly, and the bars 64, connected to the bars 63 at their outer ends, are inclined upwardly toward the ring assembly, the structures each forming a triangle support of high strength. Wheel support bars 67, 68 are pivotally affixed each to one of the bar supports 63, 64. The bars 67, 68 are each affixed to the outer end of one of the bars 63 by a bolt 69, so that each bar 67, 68 may pivot relative the pipe axis. Bars 67, 68 are connected together at their angularly upward ends by a cross bar 71. The bars 67, 68 71 form a rigid structure for supporting the wheels which engage pipe 21. Adjacent its upper end, bar 68 carries a first gear drive unit 73 which drives wheels 74, 75 through a second gear box 76. Lower wheels 78, 79 are supported on a shaft 80 the ends of which may be connected into end slots 81 of bars 67, 68 by end bolts 82. By loosening of the bolts 82, the shaft 80 and wheels 78, 79 may be removed as a unit to permit the wheel assembly to be disposed about a pipe or removed therefrom. After the bars 67, 68 have been placed to either side of the pipe, shaft 80 and wheels 78 and 79 may be replaced and bolts 82 tightened to secure the assembly.

The angularity of the bars 67, 68 is controlled and adjustable by chains 85, 86 (see FIGS. 1 and 2) which are affixed to the ring assembly 20 at their lower ends at 87, 88, respectively, and the upper ends of which are adjustably engaged with hooks 90 provided at the opposite ends of bar 71. If the pipe 21 is of relatively large diameter, the chains 85, 86 are lengthened by engaging suitable loops of the chains 85, 86 with the hooks 90. If the pipe is of smaller diameter, the chain length is taken up by engaging closer loops of the chain with the hooks 90. Therefore, the wheel assembly may be adjusted to support the ring assembly 21 vertically for any pipe diameter which will fit through the ring assembly. The weights of the apparatus elements to the right of the ring assembly in FIG. 1 and to the left of ring assembly in FIG. 2 urge lower wheels 78, 79 upwardly against the underside of the pipe, the upper wheels 74, 75 resting on the upper side of the pipe.

Four parallel support bars 95–98 of the same lengths are connected to ring gear assembly 33 to extend parallely and axially of the pipe 20 axis at the side of the ring gear assembly opposite the wheel assembly. Bars 95–98 rotate with the ring gear assembly. A cross bar 101 is supported across the free ends of bars 95, 97, extending beyond bars 95, 97 by the same amount to each side. Angular bars 102, 103 fix bars 95, 97 and 101 at right angles. A bar 105 is releasably connected between the outer ends of bars 96, 98. Bar 106 is fixed vertically between bars 95, 96, adjacent the connection of angular bars 102 thereto, bar 106 being close enough to ring assembly 120 that it will not hinder withdrawal of pipe wrapping tape from the tape spindle, to be described. Bar 107 is identically fixed vertically between bars 97 and 98 at the other side of the space through which pipe 21 is disposed.

A rectilinear frame 109 formed by interconnected bar members 110–113 is pivotally supported between one end of bar 101 and the end of bar 120, the latter depending from the end of bar 96 and being braced by an angularly disposed bar 102. Another rectilinear frame 121 formed by interconnected bar members 123–126 is pivotally supported between the other end of bar 101 and the end of bar 128, the latter depending from the end of bar 98 and being braced by an angularly disposed bar 103. The pivotal connections of bars 101, 120 to frame bars 110, 111, respectively, at one side, and the pivotal connections of bars 101, 128 to frame bars 123, 124, respectively, at the other side, are at the centers of bars 110, 111 and 123, 124.

A tape spindle assembly 130 is mounted and supported between the centers of bars 112, 113, and an identical tape spindle assembly 130 is simularly mounted and supported between the centers of bars 125, 126, one at each side of the apparatus as best shown in FIG. 3. The two assemblies 130 are inverted each with respect to the other, but are in the same position with respect to rotative movement about the pipe 21. Details of the assemblies 130, which are identical, are shown in FIGS. 4 and 13–15.

Figure 15:
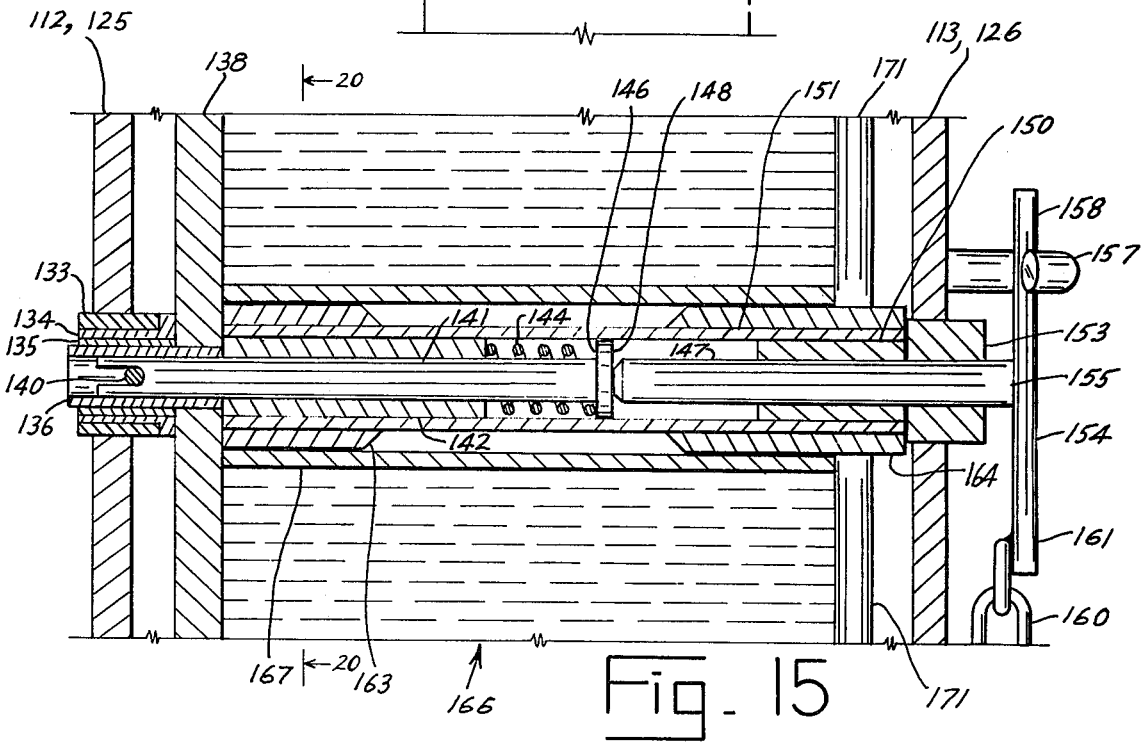
FIG. 15 is an enlarged partial axial cross section of a tape spindle assembly according to the invention.
Figure 14:
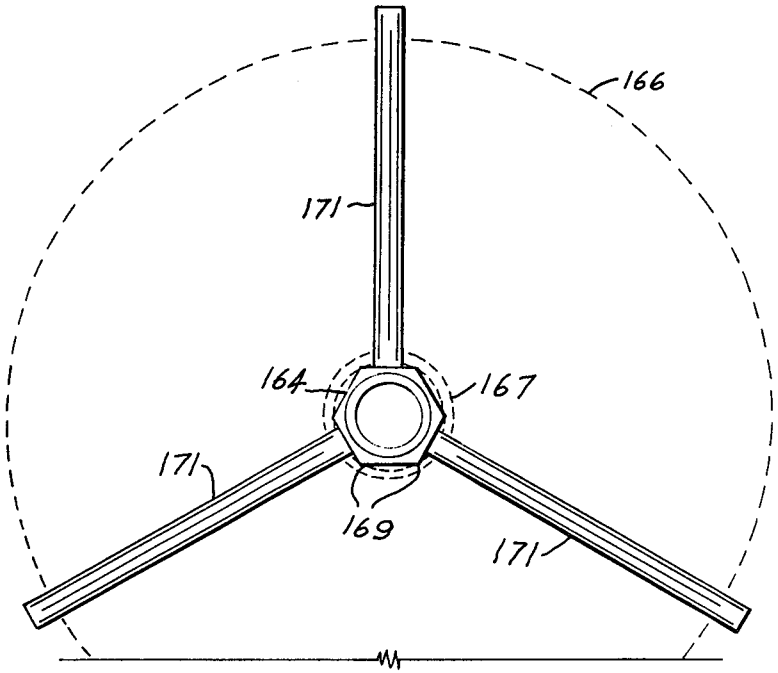
FIG. 14 is an end elevation taken at line 14—14 of FIG. 13.
Figure 13:
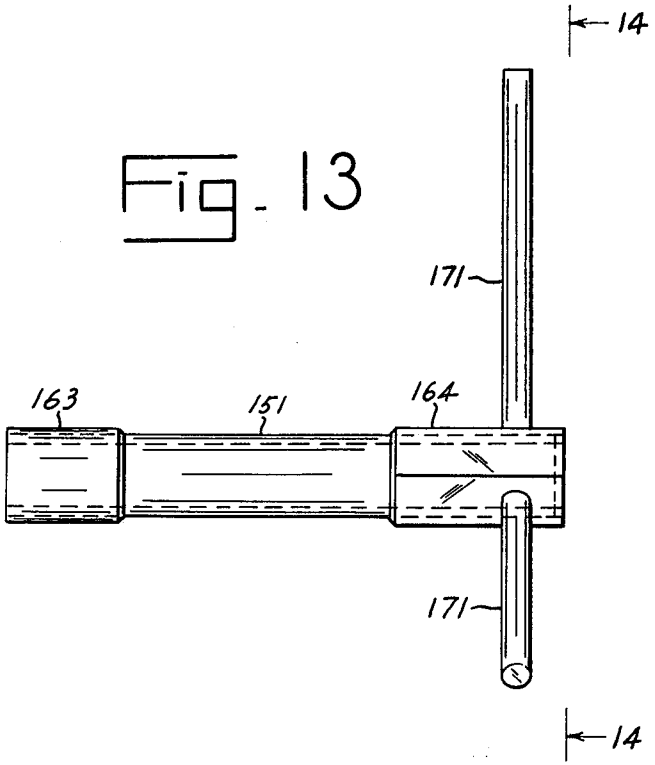
FIG. 13 is a side elevation of a tape spindle element of the apparatus.
Figure 17:
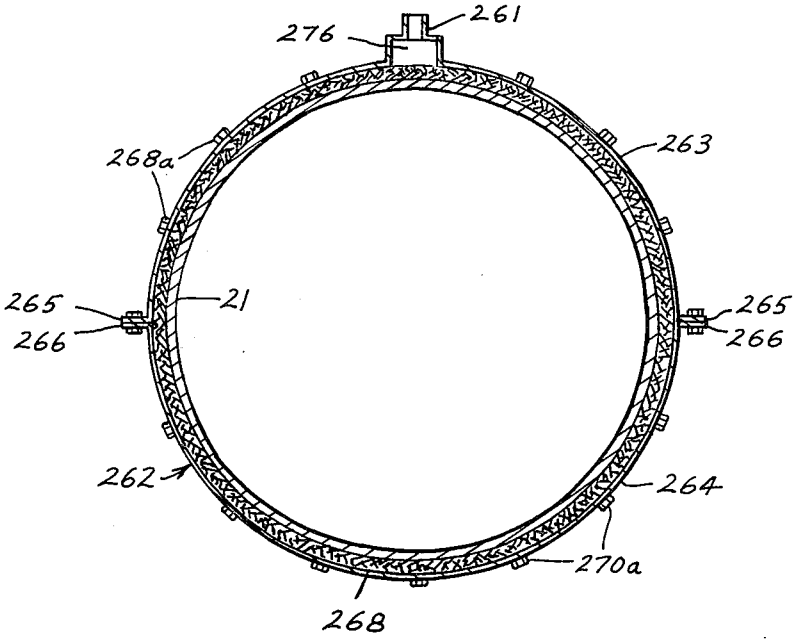
FIG. 17 is a transverse cross section taken at line 17—17 of FIG. 16.

Referring first primarily to FIG. 15 of the drawings, a sleeve 133 is fixed through each of the bars 112, 125. Spacer sleeve 134 is disposed within sleeve 133, extending around its inner end. Sleeve 135 is disposed within sleeve 134, as shown. Sleeve 136 is disposed within sleeve 135, sleeve 136 extending through a center opening of a large circular sheave 138. A pin 140 is fixed diametrically across sleeve 136. Shaft 141 is slotted at its lefthand end as shown in FIG. 15 to be removably engaged with pin 140. Sleeve 142 surrounds shaft 141 to the righthand side of sheeve 138. A helical compression spring 144 is disposed between the righthand end of sleeve 142 and enlarged end 146 of shaft 141. Spring 144 moves shaft 141 axially to the right when not constrained against such movement. Shaft 147 bears at its lefthand end against end 148 of shaft 141. Shaft 147 is disposed slidably through sleeve 150 fixed in the end of spindle sleeve 151. Thick wall sleeve 153 is fixed through an opening through the center of each bar 113, 126. Each shaft 147 has a cross bar 154 carried across its outer end 155. Each bar 113, 126 has affixed to its outer side a hook shaped element 157 with which the end 158 of each cross bar 154 may be engaged as best shown in FIG. 15. Each shaft 147 may be removed through the sleeve 153 after inward flexure of end 158 of the cross bar 154 to release it from the hooked shaped element 157, and withdrawing the shaft 147 outwardly. When this is done, compression spring 144 moves shaft 141 toward the right to clear the inner end of sleeve 136 whereby spindle sleeve 151 and the elements carried thereby may be removed. The spindle shaft assembly is replaced by the opposite procedure, by alignment of the spindle shaft with sleeve 136 and sleeve 153 and by reinsertion of shaft 147 and reengagement of end 158 of cross bar 154 with the hook formation 157. A chain or other retaining device 160 is affixed, for example by welding, to end 161 of each cross bar 154, the opposite end of the chain or other restraint being affixed to the bar 113 or 126 (see FIGS. 1 and 2). Sleeves 142, 150 and spring 144 rotate with spindle sleeve 151 about shafts 141, 147.

Each spindle sleeve 151 has a cylindrical sleeve 163, of slightly smaller diameter than the interior diameter of the tape core 167, affixed around one of its ends. Although it is not necessary, the sleeve 163 may alternatively be of a cross sectional shape such as hexagonal around its outer surface (see also FIGS. 13–14). Around its opposite end, each spindle sleeve 151 has fixed therearound a sleeve 164, which is preferably outwardly hexagonal, as shown, but which may be outwardly cylindrical or of other suitable shape, for example having longitudinal ribs at its outer surface. A roll 166 of pipe wrapping material or tape having core 167 is installed around the tape spindle while the spindle is removed, as has been previously described. The core 167 is inwardly slightly smaller than the corner portions of sleeve 164 so that the core must be forced over the sleeve 164, the core being indented at the corners 169 of the sleeve 164, thereby preventing rotation of the core on the spindle. If sleeve 163 is of outwardly hexagonal or longitudinally ribbed formed, which, as stated before, is not necessary, the core will be similarly held at its opposite end. Each sleeve 164 has a plurality of radially outwardly extending bars 171, three being shown but any suitable number of which may be used. The tape roll 166 is installed in contact with the bars 171. When the spindle sleeve 151 is reinstalled in the apparatus as shown in FIG. 15, the opposite side of the tape roll 161 bears against circular plate 138.

The spindle assembly described has the advantage that it may be readily removed for replacement of the tape roll. As previously mentioned, when shaft 147 is removed, spring 144 moves shaft 141 to the right so that the entire spindle sleeve assembly may be readily removed. After a new tape roll has been installed, the spindle assembly carrying the new tape roll may be quickly and easily replaced for use. It will be realized that spindle sleeve 151, sheave 138, and radial bars 171 rotate with the tape roll as tape is withdrawn therefrom.

Referring now to FIGS. 1, 2, 4, and 18, a brake device 174 is provided for the purpose of controlling tape tension as the tape is applied to a pipe. A brake assembly is supplied for each tape spindle assembly. A generally U-shaped support bracket 175 for each brake assembly is supported by a bracket 211 which is pivotally connected to a yoke 210, to be described. Each bracket 175 includes a bar portion 176, a somewhat wider bar portion 177 relieved at its end 178, the bar portions 176, 177 being connected by base portion 180 which is rounded at 181 and has a square corner at 182. The bracket 175 is positioned angularly so that the outer ends of the bar portions 176, 177, which are offset in the direction of bracket 211 at **176*a*, 177*a*, are disposed at opposite sides of the outer edge of each sheave 138. At recess 178, a brake lining support disc 186 having brake lining element 187 affixed thereto has a threaded stem 188 which extends through a tapped hole through bar portion 177. A nut 190 is secured thereonto to hold brake lining 187 in proper position. At the opposite side of the brake apparatus, brake lining disc 192 fixed on support disc 193 at the end of shaft 194 engages the opposite side of the sheave 138. Shaft 194 is longitudinally slidable in the bore of a sleeve 195 which is carried at the end of bar portion 176 of bracket 175. The bore through sleeve 195 is threaded at its outer end portion 196 and threaded shaft 198 is screwed thereinto. A cross bar 200 serving as a handle for shaft 198 is affixed across the end of the shaft 198, as shown. Through use of handle 200, shaft 198 may be screwed inwardly or outwardly into the threaded end portion of sleeve 195. A helical compression spring 202 is engaged between the inner ends of shafts 194 and 198. Spring 202 resiliently urges shaft 194 and brake lining disc 192 toward sheave 138 so that the brake lining disc firmly engages the surface of the sheave 138. The brake lining disc 187 at the opposite side of sheave 138 provides a backup so that sheave 138 will not be moved out of position by action of the brake. It will be realized that when shaft 198 is screwed outwardly, the pressure of brake pad 192 is reduced, and that when shaft 198 is screwed inwardly, the brake pressure of pad 192 is increased. Therefore, the braking force exerted on each sheave 138 may be readily and accurately adjusted in order that the tension of tape unwound from a tape roll 166 may be closely controlled. If increased tape tension is desired, shaft 198 is screwed inwardly, and if decreased tape tension is desired, shaft 198** is screwed outwardly.

Figure 19:
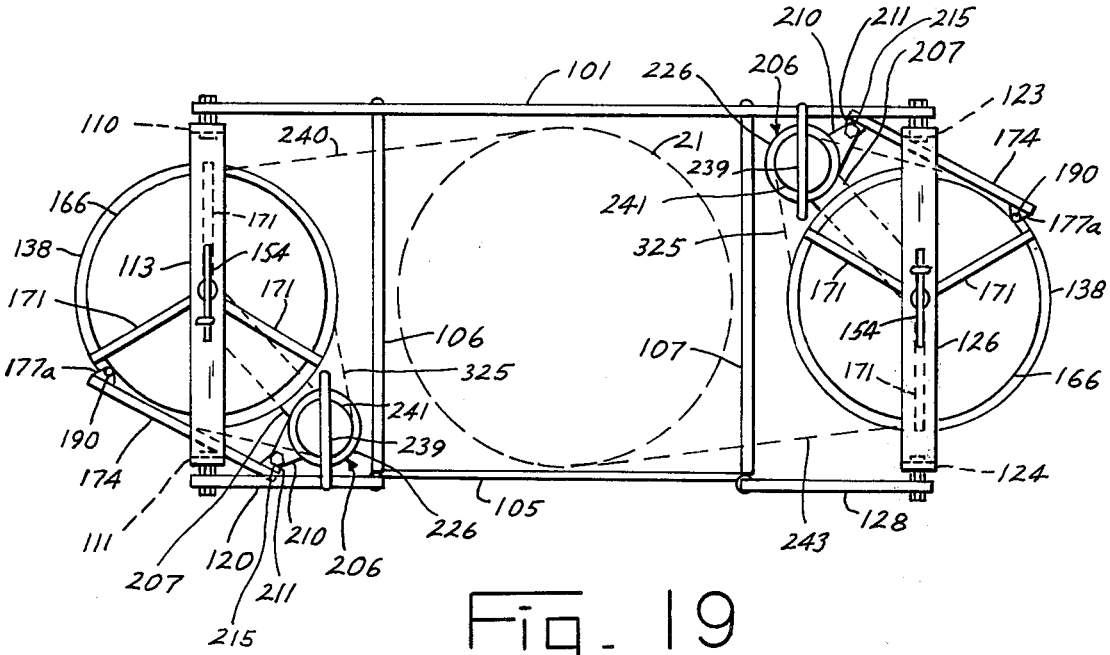
FIG. 19 is an end elevation showing the supports for the tape spindle assemblies, taken at line 19—19 of FIG. 1.
Figure 20:
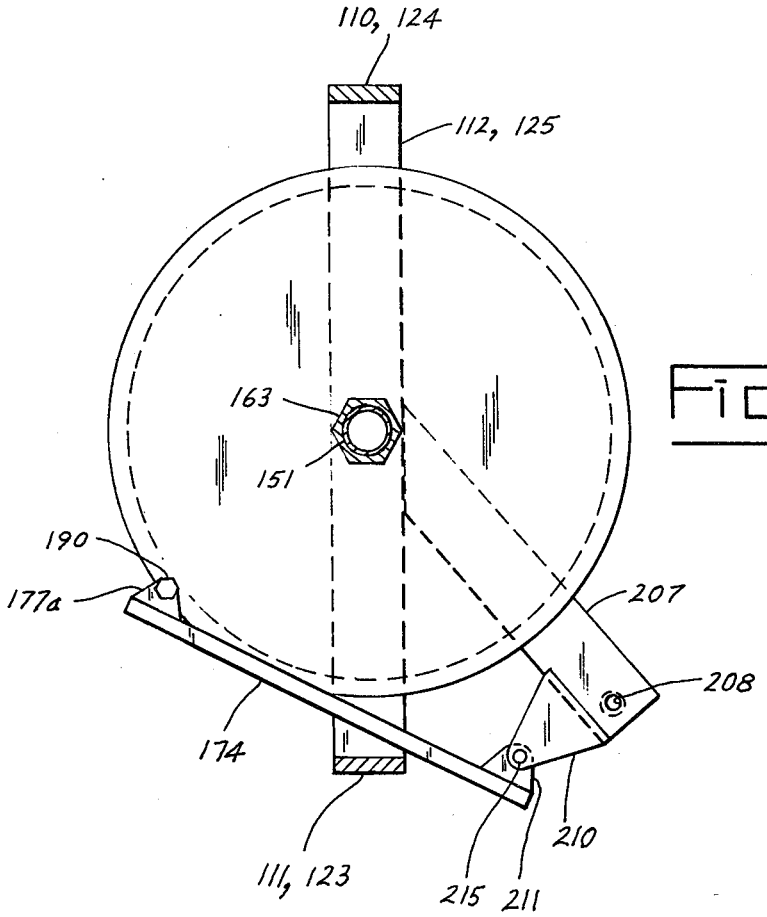
FIG. 20 is a partial vertical cross section taken at line 20—20 of FIG. 4.

Referring to FIG. 3 of the drawings, a backing take-up reel or spindle 206 is provided in association with each tape spindle assembly. One backing take-up spindle 206 is provided just above bar 120 at the lower lefthand portion of FIG. 3, and the other backing take-up spindle 206 is provided just below the righthand end of bar 101 at the upper righthand portion of FIG. 3. The backing take-up spindles are also shown in FIG. 19, wherein, for clarity, only the tape spindles and back-up spindles and supports therefor are shown. Reference should also be had to FIG. 20, which shows the supports for the take-up spindles.

Each backing take-up spindle 206 is supported by an angular bar 207, which is welded to bar 112 at one side of the apparatus and to bar 125 at the other side of the apparatus. Each bar 207 has a tapped opening 208 at its outer end into which the backing take-up spindle is screwed for support. A pair of yoke elements 210 are welded, one at each side of each bar 207, each yoke element 210 being of generally triangular shape. The bracket 211 is affixed, as earlier described, to brake bracket 175, and is pivotally engaged with yoke element 210 at pivot pin 215. The brake shoes 187, 192 are engaged at opposite sides of one of the sheaves 138.

Referring now to FIGS. 5–8 of the drawings, each backing take-up spindle has a shaft 220 at one end of which is formed a threaded stud 221 which is screwed into tapped opening 208 of a bar 207. A washer 223 is disposed around each stud 221 adjacent a sheave 224 rotatively disposed around the shaft 220. A circular plate 226 which is fixed to rotate with sheave 224 is disposed about each shaft 220 and has a pair of circularly spaced parallel rods 227, 228 dependingly affixed thereto. Each plate 226 has a hole 230 therethrough overlapped partially by sheave 224. A sleeve 223 is disposed around each shaft 220, a bronze bushing 232 being press fitted into each end as shown. Rings 235, **235*a* and split ring 236 retain sleeve 233 in place on shaft 220. Sheave 224, plate 226, and sleeve 233, which are welded together rotate together around each shaft 220**.

A rod 237 is bent angularly at 238, transversely at 239 and angularly at 240 to form a handle. The handle may be made separately and fixed to the end of rod 237. A plate 241 is affixed to the end of angular part 240 and the rod extends through an opening through plate 241 at the opposite side. Rod 237, at its lefthand end as shown in FIG. 8, is adapted to closely and slidably fit into opening 230 of plate 226. Plate 241 has a pair of openings into which rods 227, 228 pass when the lefthand end of rod 237 is inserted into hole 230. Rod 227 has a diametric opening therethrough adjacent its end beyond plate 241 into which a spring latch element 242 is inserted to retain plate 241 on the rod ends and to retain the lefthand end of rod 237 in opening 230. A chain 244 connected to U-shaped bracket 245 on rod part 238 prevents loss of spring latch 242. The backing strip from tape being wound about a pipe is wrapped about rods 227, 228 and 237. When the spindle becomes filled with backing, the backing is readily removed by withdrawing latch 242 from rod 227, upon which rod 237 carrying plate 241 may be removed from within the wound backing so that the wound backing becomes loosened on the remaining rods 227, 228 and may be removed without difficulty. Thereafter, rod 237 may be replaced and latch 242 inserted in order that additional backing may be wound about the three rods 227, 228 and 237.

Referring to FIG. 3 of the drawings, pipe wrapping tape is shown being wound about pipe 21 from the lefthand tape roll 166, along path 240, gear ring 33 and the tape spindles being rotated about the pipe in the direction of arrow 281. Backing is stripped from the tape at the lower lefthand side of tape roll 166, the backing being peeled from the tape and drawn along path 241 and wound upon the spindle 206 at that side of the apparatus. Backing is stripped from the tape of the righthand tape roll 166 in the same manner, the apparatus being inverted with respect to that shown at the left side of the drawings and the tape being wound on the pipe following path 243 and the backing being rolled onto the spindle 206 along path 244.

Figure 16:
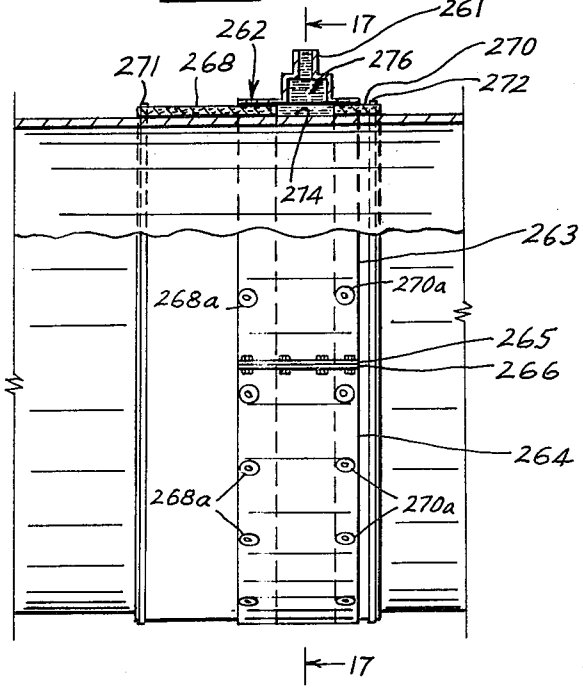
FIG. 16 is a side elevation of the pipe coating assembly according to the invention, the upper portion being shown in vertical cross section.

The apparatus 248 for coating of the pipe prior to wrapping is shown in FIGS. 1–3 and 16–17. The location of apparatus 248 is indicated by dashed lines in FIGS. 1 and 2 in order not to confuse these drawings, the apparatus 248 being shown in full detail in FIGS. 16–17. Upright bars 249, 250 are slotted as at 251 through which bolts 252 are disposed to affix bars 249, 250 to bars 44, 45 (see also FIG. 9). A storage container 255 is welded or otherwise affixed between bars 249, 250, vessel 255 having removable top 257. Vessel 255 is provided to contain a liquid pipe coating material which may be coated onto the exterior pipe surface prior to wrapping the pipe with tape. Conduit 260 disposed between bars 249, 250 and between bars 44, 45 leads to a fitting 261 carried by a sheet metal sleeve 262. The sleeve 262 is of relatively short length along the axis of the pipe and is made in two parts 263, 264 connected at each side at flanges 265, 266 suitably bolted together. A relatively wider strip 268 of fibrous material such as carpeting material is sewn or bolted with elevator bolts to form an endless loop about the pipe. One edge of loop 268 is affixed beneath one edge of sleeve 262 as shown in FIG. 16. A narrower strip of carpeting or similar material 270 is affixed at the opposite edge of strip 262, the carpeting or other similar material being formed into an endless loop around the pipe and secured in such form by sewing or tapping, or the like. Bands 271, 272 may be provided to bind the free ends of the carpeting loops 268, 270 flushly against the pipe, but are not usually necessary and may be omitted. A suitable valve is provided to control flow of the liquid coating material from vessel 255 through conduit 260 into the space 274 formed between the loops 268, 270 within sleeve 262. In operation, the pipe coating assembly operates as follows: sleeve 262 is connected to bars 63, 64 at each side of the pipe to be slidingly moved along the pipe as the apparatus moves. Loop 268 of carpeting material, or the like, is disposed in the trailing direction with regard to sleeve 262, i.e., toward the tape spindles. Liquid pipe coating material 276 is drained into the angular space 274 from vessel 255, filling the annular space. The front strip or loop 270 of carpeting material forms a seal to prevent leakage of the coating material from within sleeve 262. The wider strip 268 of carpeting material, or the like, serves to smear and levelly coat the pipe at the trailing end of the coating apparatus. The thickness of the coating may, if a band 271 is used, be controlled to a considerable degree by adjusting the tension of the band 271. Band 272, if used, may be tightened sufficiently to prevent leakage. As the coating apparatus moves along the pipe, the coating material is appled evenly and uniformly completely around the pipe, since the entire periphery of the pipe is in contact with the annular pool of coating material 276 in space 274. Band 268 of carpeting material serves to swab the coating material against the pipe surface and to uniformly level the coating applied to the pipe. It will be noted that the coating is applied to the outer pipe surface just in advance of the wrapping operation, so that the wrapping is actually done upon a freshly coated but not dried surface so that the wrapping material will be firmly adhered and sealed to the pipe surface. Carpet strips 268, 270 are affixed to sleeve 263 by elevator bolts **268*a*, 270*a***, respectively.

Referring to FIG. 1, the gear ring 33 is driven in rotation by a hydraulic or pneumatic drive motor 280 which is supported by bars 63, 64 at one side of the apparatus. Shaft 281 of the drive motor has at its end a sprocket 282. The direction of rotation of gear ring 33 around ring assembly 20 is in the direction of arrow 281 shown in FIG. 3. The two tape strips following paths 240, 243 from the tape rolls are wrapped onto the pipe in the same direction relative the pipe, the tape from one roll being wrapped to overlap the tape wrapped from the other roll. Endless drive chain 285 around sprocket 282 engages the teeth of ring gear 33 as shown best in FIG. 3 to rotate ring gear 33. Chain 285 passes around sprocket 286 carried on a shaft 287 to rotate the shaft. A larger sprocket 289 also carried on shaft 287 has endless chain 291 therearound which also engages around a sprocket 292 keyed to a shaft 293. Shaft 293 has idler sprocket 294 freely carried thereon over which the upper run of chain 285 is disposed. Shaft 293 is rotated by rotation of sprocket 289 through chain 291.

Figure 12:
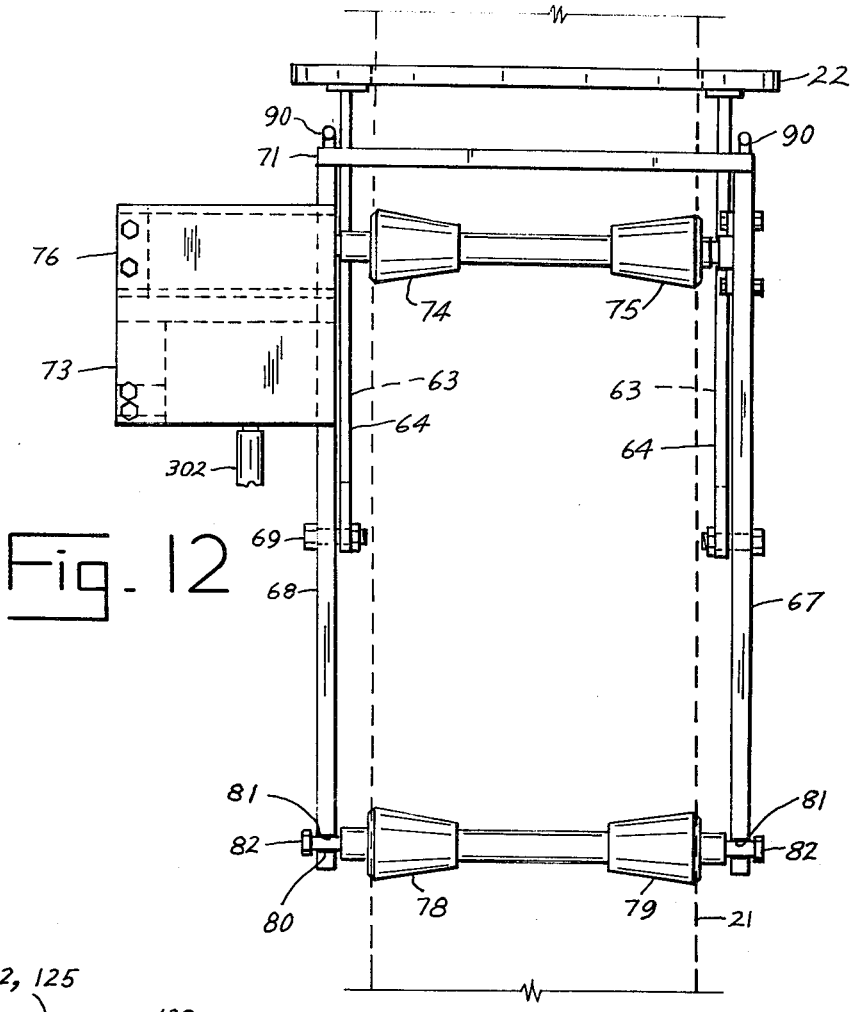
FIG. 12 is an upper side elevation of the carriage assembly of the apparatus.

Referring also to FIG. 2, a drive cable 298 disposed in housing 299 is connected by end fitting 301 to shaft 293. The opposite end of drive cable 298 is connected by connection fitting 302 to gear box 73. Gear box 73 is connected through drive unit 76 to drive wheels 74, 75 (FIGS. 1, 2, and 12).

A supply pipe 310, flow through which is controlled by needle valve 311 and shut off valve 312, has fitting 314 to which connection may be made to a pneumatic or hydraulic fluid supply conduit. Suitable connection between pipe 310 and drive motor 280 is made through conduit 318 (FIG. 1). Various other controls 320 for the drive motor are provided, which are conventional and may be readily provided by those skilled in the art. These elements are supported by the bars 63, 64 at that side of the apparatus.

To use the apparatus in wrapping a pipe, chains 85 and 86 are released from hooks 90 so that lower wheels 79 may be moved downward. Shaft 80 carrying wheels 78 and 79 is removed from slots 81. Bar 105 is swung out of the way or removed. The lower portions of rings 20 and 33 are swung down and out of the way. With the apparatus in this condition, it may be lowered onto a pipe 21. The elements beneath the pipe are reconnected and the wheels 78 and 79 are replaced, after which the chains 85 and 86 are hooked to the hooks 90 at the upper end of the wheel assembly such that the apparatus is parallel with the pipe and all wheels 74–75 and 78–79 are engaged with the pipe. The ends of the tapes on rolls 166 are each placed partway about the pipe at the required angularity at which the tapes are to be wrapped onto the pipe. Then the controls for drive motor 280 are adjusted to the proper drive speed for the rotation of ring gear 33 and for rotation of drive wheel 75. The control valve for the liquid pipe coating material in vessel 255 is opened. The apparatus travels along the pipe in a direction from right to left in FIG. 1 and in a direction from left to right in FIG. 2. The drive belts 325 each disposed around a sheave of a tape spindle and around a sheave 224 of a backing take-up spindle are rotated automatically as the apparatus travels along the pipe in this manner. The pipe is coated with coating material 276 and then the two tapes are wrapped helically thereover. When the take-up spindles 206 become filled, the apparatus is stopped and the backing rolled on the take-up spindles is removed and the backing reattached thereto for winding of additional backing onto the spindles. When the wrapping tape has been used up on either or both of the rolls 166, the tape spindles are released as has been described and fresh tape rolls supplied.

Because of the pivotal mountings of the tape spindles and tape rolls, the tape does not wrinkle when wrapped onto the pipe. The tape has equal tension across its width and no angular strains are created in the tape. The overlap of successive runs or wraps of the tape about the pipe remains uniform since the tape angles are maintained constant.

The apparatus is adjustable for use on different sizes of pipes. As should already be understood, the wheels 74–75 and 78–79 are adjusted for different pipe sizes by adjustments of the angularities of bars 67, 68 and adjustments of the effective lengths of claims 85, 86. In addition, referring again to FIG. 4, the spindle assemblies 108 may each be moved inwardly for smaller pipes and outwardly for larger pipes by moving the frames 109, 121 for pivotal support at any of the holes 360 of bar 101 and bars 120, 128, the holes being in alignment for proper positionings of the spindle assemblies as will be evident.

One other adjustment, not shown in the drawings, is useful. The pipe wrapping tape widths may be reduced by insertion of spaces of identical lengths at opposite sides of the tape roll on spindle sleeves 151. It is essential for proper operation that the spacers be of equal lengths, so that the centers of the tape rolls will coincide with the pivotal axes of the frames 109, 121, as otherwise the tape rolls would tend to assume improper angles or cants with respect to the tape unwound from the tape rolls.

It will be realized that according to the invention a very simple and easily operated apparatus is provided. Except for control of speed of operation, the operation is substantially automatic once commenced. It will, of course, be realized that tape may be wound onto a pipe without the use of the coating material if desired, and the pipe coating assembly may be completely removed from the apparatus.

While a preferred embodiment of apparatus according to the invention has been shown in the drawings and described, many modifications thereof may be made by a person skilled in the art without departing from the spirit of the invention, and it is intended to protect by Letters Patent all forms of the invention falling within the scope of the following claims.

I claim:

1. Pipe wrapping apparatus, comprising non-rotative ring means disposable coaxially around a pipe to be wrapped, driven ring means supported by said non-rotative ring means for coaxial rotation about the pipe, wheeled support means supporting said non-rotative ring means and having wheels engageable with the pipe for movement of said apparatus along the pipe, at least one spindle support means supported by said driven ring means for rotation about the pipe therewith, a pipe wrapping tape spindle supported by each said spindle support and each said spindle support means being supported for pivotal movement about an axis transverse to the center of the axis of the tape spindle supported thereby, whereby either end of each tape spindle may move closer to the pipe than the other end thereof in order that tape from a tape roll mounted on the tape spindle may be wound helically around the outer surface of the pipe at any selected helical angle, said pivotal support of each said spindle support means providing that each said tape roll will be aligned automatically with the tape being helically wound onto the pipe with uniform tape tension across the width of the tape.

2. The combination of claim 1, including two said spindle support means disposed at opposite sides of the pipe, and a said tape spindle supported by each said spindle support means.

3. The combination of claim 1, said pivotal movement of each said spindle support means being such that the tape spindle supported thereby is pivotally movable about its center in a plane intersecting the axis of the pipe.

4. The combination of claim 1, including parallel bar means disposed at opposite sides of the pipe in a plane perpendicular to the pipe axis and supported by said driven ring means axially spaced therefrom, each said spindle support means comprising rectilinear frame means each pivotally supported at the centers of opposite sides thereof which are parallel to the pipe axis between outer ends of said bar means.

5. The combination of claim 4, said tape spindle supported by each said spindle support means being rotatively supported between central portions of opposite sides of said frame means which are perpendicular to the pipe axis.

6. The combination of claim 1, said parallel bar means comprising a continuous bar at one side of the pipe and, at the other side of the pipe, a bar assembly having a removable central portion enabling disposition of the apparatus about the pipe from a side of the pipe, said continuous bar and said bar assembly being supported by plural circularly spaced bars depending from said driven ring means.

7. The combination of claim 6, including drive means supported by said non-rotative body means for driving said driven ring means in rotation about the pipe.

8. The combination of claim 7, said drive means comprising a fluid motor having a shaft driven in rotation thereby, a drive sprocket carried by said shaft, said driven ring means having sprocket means therearound, and chain means engaging said drive sprocket and sprocket means to drive said driven ring means in rotation about its axis when said fluid motor is operated.

9. The combination of claim 1, said wheeled support means comprising a pair of bracket means depending from said non-rotative ring means at diametrically opposite sides thereof and at the face thereof opposite said tape spindles, a pair of parallel arms each pivotally supported at an intermediate point thereof by one of said bracket means and being pivotally movable in a plane parallel to said non-rotative ring means axis, length-adjustable linking the inner end of each said arm to said non-rotative ring means, a set of upper wheels disposed above the pipe carried by a shaft extending between the inner end portions of said arms, a set of lower wheels disposed below the pipe carried by a shaft extending between the outer end portions of said arms, said upper and lower sets of wheels being simultaneously movable toward or away from the pipe axis by adjustments of the lengths of said length-adjustable means, whereby said sets of wheels may be adjusted in position to engage pipes of different diameters.

10. The combination of claim 1, including a backing take up spindle disposed adjacent each said tape spindle onto which backing stripped from the tape is wound, each said backing take up spindle being disposed parallely adjacent the tape spindle and being supported by support means depending from said bar assembly.

11. The combination of claim 10, including a backing take up spindle supported parallely adjacent each said tape spindle, means for rotating each backing take up spindle in response to rotation of the associated tape spindle, backing being stripped from the back of the tape as the tape is unwound from the tape roll to be wrapped around the pipe and the backing being wound onto the backing take up spindle by said rotation thereof.

12. The combination of claim 11, said means for rotating each backing take up spindle in response to rotation of the associated tape spindle comprising circular drive engagement means concentric with said backing take up spindle and circular drive engagement means concentric with said tape spindle and a loop drive transfer means engaged around both said circular drive engagement means.

13. The combination of claim 12, each said circular drive engagement means comprising a sheave and said loop drive transmission means comprising a drive belt.

14. The combination of claim 12, each said circular drive engagement means comprising a sprocket and said loop drive transmission means comprising a drive chain.

15. The combination of claim 12, said backing take up spindle having plural circularly spaced circularly rotating bars about which said backing is wound, one of said bars being removable in an axial direction whereby the backing wound around said bars is loosened for removal thereof.

16. The combination of claim 10, each said backing take up spindle comprising a central stationary shaft having an end thereof connected to said support means, a sleeve rotatably disposed around said central shaft and having a sheave fixed therearound at its end adjacent said support means and having a circular plate fixed therearound adjacent said sheave, plural circularly spaced bars extending from said circular plate parallel to said central shaft, a removable bar received into a hole in said circular plate at its inner end and being circularly spaced with said circularly spaced bars, said removable bar having a plate transversely fixed thereto adjacent its outer end and said transverse plate having circularly spaced holes therethrough to receive the outer ends of said circularly spaced bars therethrough, means for releasably fixing at least one of said circularly spaced bars through said hole through said transverse plate to hold said removable bar in said circular plate, means engaging said sheave to rotate said plates and bars, the backing stripped from the tape being wound around said circularly spaced bars and said removable bar, removal of said removable bar causing loosening of the wound backing whereby it may be slid from around said circularly spaced bars.

17. The combination of claim 16, each said tape spindle having sheave means fixed therearound, said means engaging said backing take up spindle sheave to rotate said plates and bars comprising a drive belt looped around said backing take up spindle sheave and said tape spindle sheave, whereby said backing take up spindle is rotated by rotation of said tape spindle.

18. The combination of claim 1, including means for applying pipe coating liquid to the surface of the pipe prior to wrapping said tape thereon, comprising a central sleeve connected to said apparatus spacedly encircling the pipe to provide an annular space between the outer surface of the pipe and said central sleeve, compressible sleeve means sealingly disposed between said sleeve and the pipe at each end of said annular space, means for introducing pipe coating liquid to fill said annular space, whereby when said apparatus is moved along the pipe the exterior surface thereof is coated with said pipe coating liquid, the compressible sleeve means at the trailing end of said central sleeve with respect to the direction of apparatus movement forming a uniform coating of said pipe coating liquid on the pipe.

19. The combination of claim 18, said compressible sleeves extending beyond said central sleeve at each end of said central sleeve, band means around the extending end of each compressible sleeve to control the pressure thereof against the pipe.

20. The combination of claim 19, the compressible sleeve at the upstream end of said central sleeve being shorter than the compressible sleeve at the downstream end of said central sleeve.

21. The combination of claim 19, said compressible sleeves being formed by carpeting material having the pile side thereof disposed against the outer pipe surface.

22. The combination of claim 9, said shaft carrying said lower set of wheels being releasably connected to said arms, whereby said arms may be installed at opposite sides of the pipe or removed from a side of the pipe.

23. The combination of claim 22, said non-rotative ring means and said driven ring means each having a releasable ring portion which may be opened whereby said ring means may be placed about a pipe or removed from a side of the pipe.

24. The combination of claim 9, including drive motor means for driving said spindle support means and said tape spindles about the pipe to wrap tape about the pipe, and flexible drive cable means connected between said drive motor means and said set of upper wheels to rotate said set of upper wheels to propel the apparatus along the pipe.

25. The combination of claim 24, said drive motor means comprising a fluid motor supported by said non-rotative ring means.

* * * * *